US011147379B2

(12) United States Patent
Smith et al.

(10) Patent No.: US 11,147,379 B2
(45) Date of Patent: Oct. 19, 2021

(54) CUSHION FOR FOLDING CHAIR

(71) Applicant: Mity-Lite, Inc., Orem, UT (US)

(72) Inventors: Richard D. Smith, Orem, UT (US); Matthew Pectol, Provo, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 16/547,997

(22) Filed: Aug. 22, 2019

(65) Prior Publication Data

US 2021/0052077 A1 Feb. 25, 2021

(51) Int. Cl.
*A47C 4/06* (2006.01)
*A47C 7/02* (2006.01)

(52) U.S. Cl.
CPC . *A47C 4/06* (2013.01); *A47C 7/02* (2013.01)

(58) Field of Classification Search
CPC .... A47C 4/06; A47C 4/30; A47C 7/02; A47C 7/24
See application file for complete search history.

(56) References Cited

U.S. PATENT DOCUMENTS

| | | | | |
|---|---|---|---|---|
| 157,028 | A | | 11/1874 | Savoral |
| 1,181,357 | A | | 5/1916 | Thonet |
| 1,873,768 | A | | 8/1932 | Kux |
| 1,975,622 | A | | 10/1934 | Schermerhorn |
| D107,545 | S | | 12/1937 | O'Connor |
| 2,186,301 | A | | 1/1940 | La More |
| 2,364,093 | A | | 12/1944 | O'Connor |
| 2,877,829 | A | * | 3/1959 | Ferar ..... A47C 4/24 297/55 |
| 3,001,816 | A | | 9/1961 | Clarin |
| 3,094,357 | A | | 6/1963 | Shwayder |
| 3,463,547 | A | | 8/1969 | Brennan et al. |
| 3,708,202 | A | * | 1/1973 | Barecki ..... A47C 4/028 297/239 |
| 3,774,967 | A | | 11/1973 | Rowland |
| 3,840,269 | A | | 10/1974 | Ambrose |
| 4,304,436 | A | | 12/1981 | Rowland |
| 4,368,917 | A | | 1/1983 | Urai |
| 4,502,731 | A | | 3/1985 | Snider |
| 4,660,887 | A | | 4/1987 | Fleming et al. |

(Continued)

OTHER PUBLICATIONS

Herman Miller for business—Mirra Chairs, www.hermanmiller.com/CDA/SSA/Product?0,,a10-c440-p205,00.html, accessed Apr. 8, 2009, 3 pages.

(Continued)

*Primary Examiner* — Philip F Gabler
(74) *Attorney, Agent, or Firm* — Thorpe, North & Western, LLP

(57) ABSTRACT

A chair comprises a seat and a backrest carried between opposite frame sides each with a backrest support, a front leg and a rear leg. The seat comprises an upholstered seat cushion disposed on the seat. The upholstered seat cushion comprising a cushion layer carried by a backing and covered by a layer of upholstery. The layer of upholstery extends over the cushion layer and the backing, and wraps around a perimeter of the backing. A snap connection attaches the backing of the upholstered seat cushion to the seat. The snap connection comprises resilient hooks extending from backing of the seat cushion and into holes in the seat.

19 Claims, 10 Drawing Sheets

(56) References Cited

U.S. PATENT DOCUMENTS

| | | | | |
|---|---|---|---|---|
| 4,953,913 | A | 9/1990 | Graebe | |
| 5,154,485 | A | 10/1992 | Fleishman | |
| 5,297,851 | A * | 3/1994 | Van Hekken | A47C 3/00 297/452.14 |
| D357,365 | S | 4/1995 | Ward et al. | |
| 5,524,963 | A | 6/1996 | Barile | |
| 5,662,383 | A | 9/1997 | Hand | |
| 5,681,093 | A * | 10/1997 | Pfister | A47C 3/12 297/452.65 |
| D406,195 | S | 3/1999 | Gamberini | |
| 6,099,073 | A | 8/2000 | Bruschi | |
| D431,400 | S | 10/2000 | Grove | |
| D432,805 | S | 10/2000 | Smith | |
| 6,135,562 | A * | 10/2000 | Infanti | A47C 7/40 297/440.14 |
| 6,234,571 | B1 | 5/2001 | Atkins et al. | |
| 6,305,750 | B1 * | 10/2001 | Buono | A47C 7/425 297/440.1 |
| D460,300 | S | 7/2002 | Fifield et al. | |
| D465,940 | S | 11/2002 | Nien | |
| D473,727 | S | 4/2003 | Tsai | |
| 6,543,842 | B2 | 4/2003 | Haney | |
| D476,162 | S | 6/2003 | Finazzi | |
| D477,470 | S | 7/2003 | Haney et al. | |
| 6,612,654 | B2 * | 9/2003 | Laws | A47C 4/24 297/218.1 |
| D494,792 | S | 9/2004 | Schmitz et al. | |
| D501,613 | S | 2/2005 | Kaltemnark et al. | |
| 6,871,906 | B2 | 3/2005 | Haney | |
| D506,325 | S | 6/2005 | Farber et al. | |
| 6,908,159 | B2 | 6/2005 | Prince et al. | |
| D507,425 | S | 7/2005 | Ashby et al. | |
| 6,935,698 | B1 * | 8/2005 | Chen | A47C 4/02 297/440.22 |
| 6,969,121 | B2 * | 11/2005 | Drajan | A47C 7/40 297/440.2 |
| D523,254 | S | 6/2006 | Nye et al. | |
| 7,111,906 | B2 | 9/2006 | Heisey et al. | |
| D544,235 | S | 6/2007 | Chen | |
| 7,338,116 | B1 | 3/2008 | Lin et al. | |
| D581,708 | S | 12/2008 | Su | |
| D599,127 | S | 9/2009 | Smith | |
| 8,029,059 | B2 | 10/2011 | Smith et al. | |
| 8,033,598 | B2 | 10/2011 | Smith et al. | |
| 8,033,612 | B2 | 10/2011 | Smith et al. | |
| 8,038,221 | B2 | 10/2011 | Smith et al. | |
| D648,554 | S | 11/2011 | Smith | |
| D660,612 | S | 5/2012 | Smith | |
| 8,317,269 | B2 | 11/2012 | Smith | |
| 8,322,787 | B2 | 12/2012 | Smith | |
| 8,454,093 | B2 * | 6/2013 | Smith | A47C 4/48 297/440.11 |
| 8,998,338 | B2 * | 4/2015 | Vander Veen | A47C 7/462 297/452.55 |
| 9,351,577 | B2 * | 5/2016 | Rogers | A47C 7/185 |
| 9,492,014 | B1 | 11/2016 | Smith et al. | |
| 2001/0033100 | A1 | 10/2001 | Haney | |
| 2003/0127887 | A1 | 7/2003 | Laws et al. | |
| 2009/0146467 | A1 | 6/2009 | Waite et al. | |
| 2010/0156155 | A1 | 6/2010 | Smith | |
| 2010/0156156 | A1 | 6/2010 | Smith | |
| 2010/0181807 | A1 | 7/2010 | Smith | |
| 2011/0175412 | A1 * | 7/2011 | Piretti | A47C 3/045 297/239 |
| 2013/0147252 | A1 | 6/2013 | Schmitz et al. | |

OTHER PUBLICATIONS

Herman Miller—for business—aeron chairs, www.hermanmiller.com/CDA/SSA/Product/1,1592,a10-c440-p8,00.html, accessed Jan. 29, 2009, 4 pages.

Aeron chairs, Herman Miller aeron chair, aeron loaded chirs & aeron chair accesso . . . , www.hermanmillerseating.com/aeron%AE-C79906.html?refid=G2772.%22herman . . . accessed Jan. 29, 2009, 4 pages.

DuraMesh Folding Chair, KI A versatile folding chair with a comfortable, durable mesh seat, www.ki.com, accessed Oct. 2009, 2 pages.

Mity-Lite 2010 Product Catalog; Aug. 2010; 33 pages.

Mity-Lite Product Brochure: Comfort Seating Banquet Chairs; Classic Series; 2011; 2 pages.

Mity-Lite Product Brochure; Comfort Seating. Banquet Chairs; Essential Series; 2011; 2 pages.

Mity-Lite Product Brochure; Comfort Seating, Banquest Chairs; Prestige Series; 2011; 2 pages.

Mity-Lite Product Brochure; Stylex, Zephyr; 8 pages; upon information and published 2012.

* cited by examiner

CUSHION FOR FOLDING CHAIR

BACKGROUND

Field of the Invention

The present invention relates generally to chairs. More particularly, the present invention relates to a chair with a cushion.

Related Art

Folding chairs provide seating when desired, and can be stored when not needed. It is desirable that folding chairs provide both a storage configuration as well as a comfortable seating surface. One such example of a successful folding chair is Mity-Lite's Mesh-One® and OneSeries® Pro and FlexOne® folding chairs.

SUMMARY OF THE INVENTION

It has been recognized that it would be advantageous to develop a light-weight, durable chair, or folding chair, with additional comfort, such as with a seat cushion and/or a backrest cushion. In addition, it has been recognized that it would be advantageous to develop a seat cushion for a chair that utilizes an existing seat of the chair.

The invention provides a chair comprising a seat and a backrest carried between opposite frame sides each with a backrest support, a front leg and a rear leg. The seat comprises an upholstered cushion disposed on the seat. The upholstered cushion comprises a cushion layer carried by a backing and covered by a layer of upholstery. The layer of upholstery extends over the cushion layer, and wraps around a perimeter of the backing. A snap connection attaches the backing of the upholstered cushion to the seat. The snap connection comprises resilient hooks extending from the backing of the upholstered cushion and into holes in the seat.

In addition, the invention provides a folding chair comprising a seat and a backrest carried between opposite frame sides each with a backrest support, a front leg and a rear leg. The seat and frame sides have an unfolded seating position in which the seat pivots to extend from the frame sides, and bottoms of the front and rear legs move apart, and a folded position in which the seat pivots toward the frame sides, and the front and rear legs move together. The seat has a continuous sheet of flexible and elastic patterned open texture plastic held taut across and substantially covering an opening in a hoop fixed between the frame sides. The sheet of patterned open texture plastic comprises a sheet of plastic material with an arrangement of openings across the sheet. The sheet of patterned open texture plastic has an upper surface, defining a first seat surface. A seat cushion is disposed on the seat and covers the first seat surface. The seat cushion comprises a cushion layer carried by a backing and covered by a layer of upholstery. The backing and the cushion layer are shaped to match the seat. The layer of upholstery extends over the cushion layer and the backing, and wraps around a perimeter of the backing. A snap connection attaches the backing of the seat cushion to the seat. The snap connection comprises resilient hooks extending from the backing and into the openings in the sheet of the seat.

Furthermore, the invention provides a cushion for a chair. The cushion comprises: a backing, a cushion layer carried by the backing, and a layer of upholstery extending over the cushion layer and wrapped around a perimeter of the backing. The cushion also comprises a snap connection to attach the backing to a seat of the chair. The snap connection comprises resilient hooks extending from the backing and configured to extend into openings in the seat.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
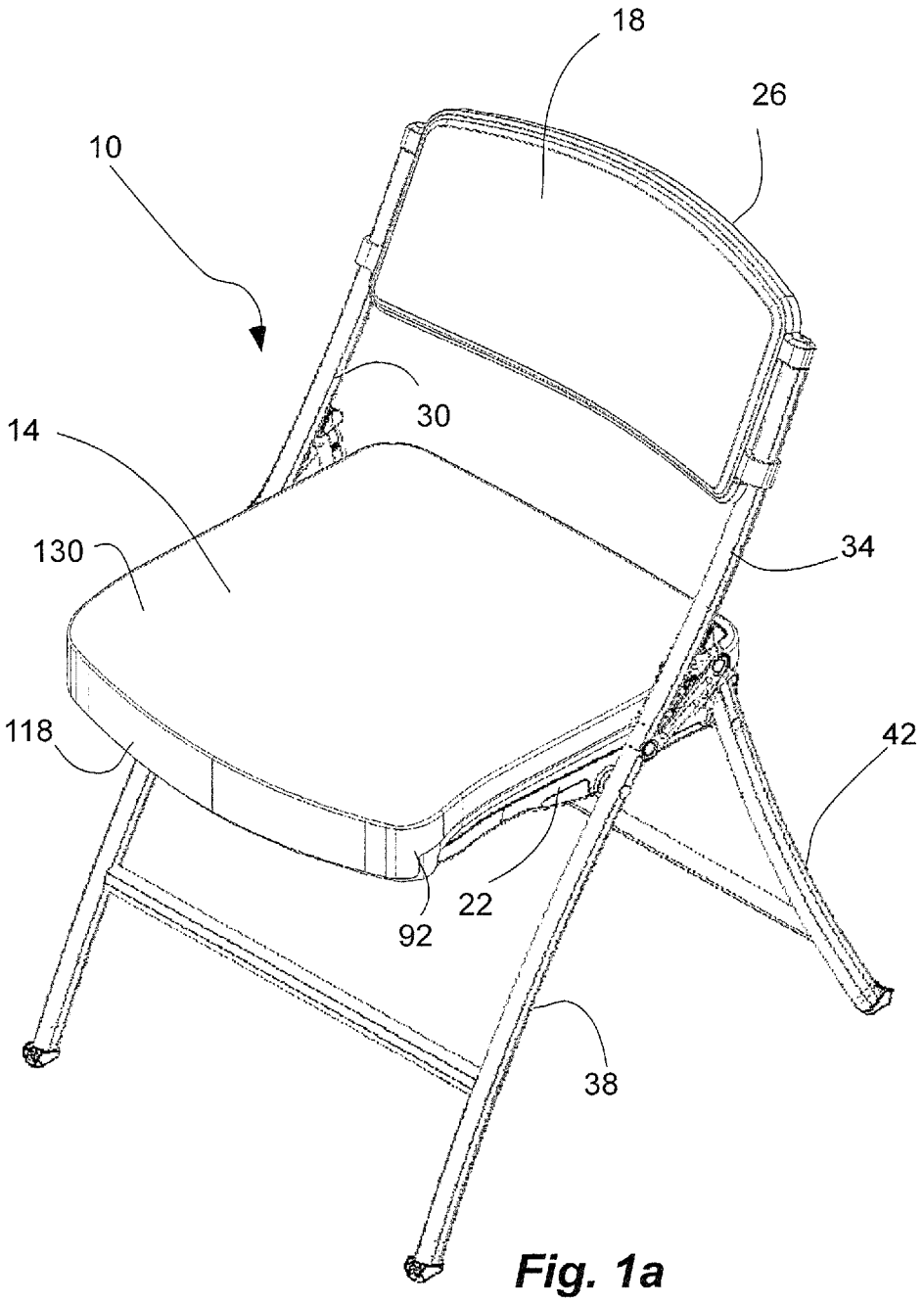
FIG. 1*a* is a perspective view of a folding chair with cushions in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment. Furthermore, the described features, structures, or characteristics may be combined in any suitable manner in one or more embodiments. In this description, numerous specific details are provided, such as examples of layouts, distances, network examples, etc. One skilled in the relevant art will recognize, however, that many variations are possible without one or more of the specific details, or with other methods, components, layouts, measurements, etc. In other instances, well-known structures, materials, or operations are not shown or described in detail but are considered well within the scope of the disclosure.

Example Embodiments

An initial overview of technology embodiments is provided below and specific technology embodiments are then described in further detail. This initial summary is intended to aid readers in understanding the technology more quickly but is not intended to identify key or essential features of the technology nor is it intended to limit the scope of the claimed subject matter.

A chair, such as a folding chair, can be provided with one or more upholstered cushions, such as an upholstered seat cushion and/or an upholstered backrest cushion. The chair can be formed with a plastic seat and/or a plastic backrest that can deflect under an applied force, namely the weight of a user, to provide comfort when seated. The upholstered seat and/or backrest cushion can provide additional comfort, as well as an upholstered finished that can be selected for the aesthetical preferences of the user. In one aspect, the chair can be an existing chair with an existing seat and/or backrest to which the seat and/or backrest cushion can be added. The cushion can be attached taking advantage of an existing structure of the seat, or chair or backrest thereof. The seat of the chair can be plastic and relatively hard, and can have a first seat surface that is an existing, finished, usable seat surface upon which a user directly sits. The upholstered seat cushion can include fabric and foam, and can be relatively soft, and can have a second seat surface that is a finished, usable seat surface upon which the user directly sits. The design of the upholstered seat cushion, such as a thickness of the foam, can be reduced with respect to typical foam thicknesses for chairs, and can take advantage of the existing flexibility of the seat.

In one aspect, the upholstered seat and/or backrest cushion can be attached to the seat and/or backrest, respectively, with a snap connection having hooks received in holes. In another aspect, resilient hooks of the seat and/or backrest cushion can extend into existing holes in the seat and/or backrest, respectively. In another aspect, the chair can have a seat cushion with a second seat surface that can be disposed over a first, existing seat surface of the chair. Thus, the first, existing seating surface can provide support to the seat cushion. In addition, the seat cushion and the seat can work together to provide comfort, with both deflecting under the applied force or user weight. In addition, the snap connection can utilize existing holes in the seat to receive hooks from the seat cushion. Furthermore, the seat cushion can have guide posts received in the holes of the seat to align the seat cushion with the seat, and thus the hooks with the hoes. Thus, the seat cushion can be provided to supplement and enhance, in aesthetics and/or comfort, and existing plastic seat.

In another aspect, the backrest can have a recess with openings in a bottom of the recess to receive hooks from the backrest cushion. The recess can provide a depth to allow the hooks to have sufficient length to flex during engagement with the openings. The openings in the backrest can be located in a sidewall of the recess to help conceal the hooks.

In another aspect, the seat and/or backrest cushion can have a cushion layer carried by a backing and covered by a layer of upholstery. The backing can have an angled lip to receive a perimeter of the upholstery behind the angled lip to resist a bunch in the upholstery from forming a gap between the cushion and the seat and/or backrest.

As illustrated in FIGS. 1*a*-11, a chair, indicated generally at 10, in an example implementation in accordance with the invention is shown with upholstered cushions, namely a seat cushion 14 and a backrest cushion 18. The chair 10 can be provided with one or both of the cushions 14 and 18. The chair 10 comprises a seat 22 and a backrest 26 carried by a chair frame 30. The chair frame 30 can comprises opposite frame sides each having a backrest support 34, a front leg 38 and a rear leg 42.

In one aspect, the chair 10 can be a folding chair, with the legs 38 and 42 pivotally coupled to one another, and foldable together and apart, and the seat 22 and the backrest 26 pivotally coupled to one another and foldable together and apart. The chair 10 can have an unfolded seating position and a folded storage position. In the unfolded seating position, the seat 22 pivots to extend from the frame sides, and bottoms of the front and rear legs 38 and 42 are moved apart or are spaced-apart. In the folded storage position, the seat 22 pivots towards the frame sides, and the front and rear legs 38 and 42 move together, substantially adjacent one another.

Figure 1B:
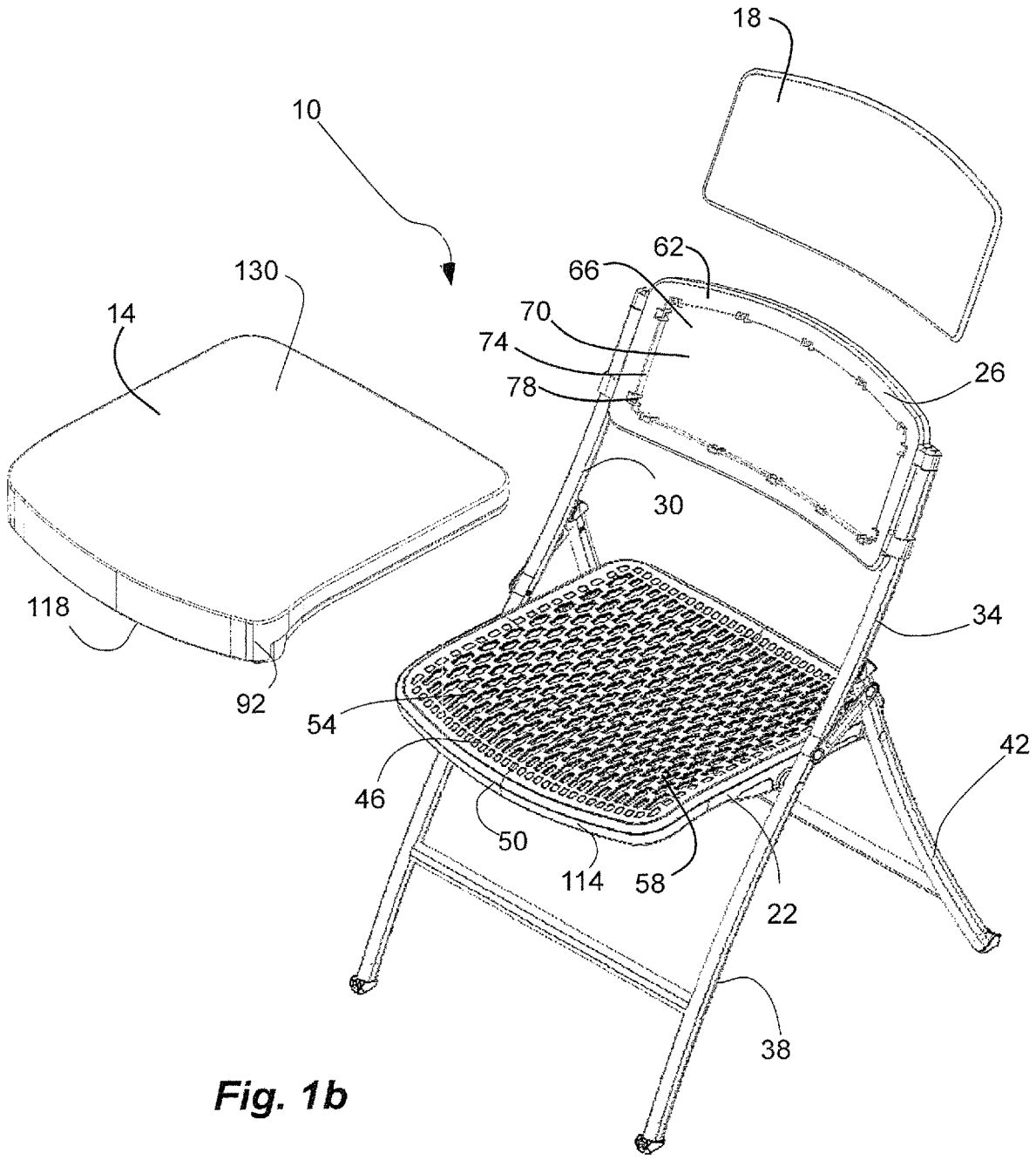
FIG. 1*b* is an exploded perspective view of the folding chair of FIG. 1*a*, showing a seat cushion separated from a seat of the folding chair, and a backrest cushion separated from a backrest of the folding chair.
Figure 1C:
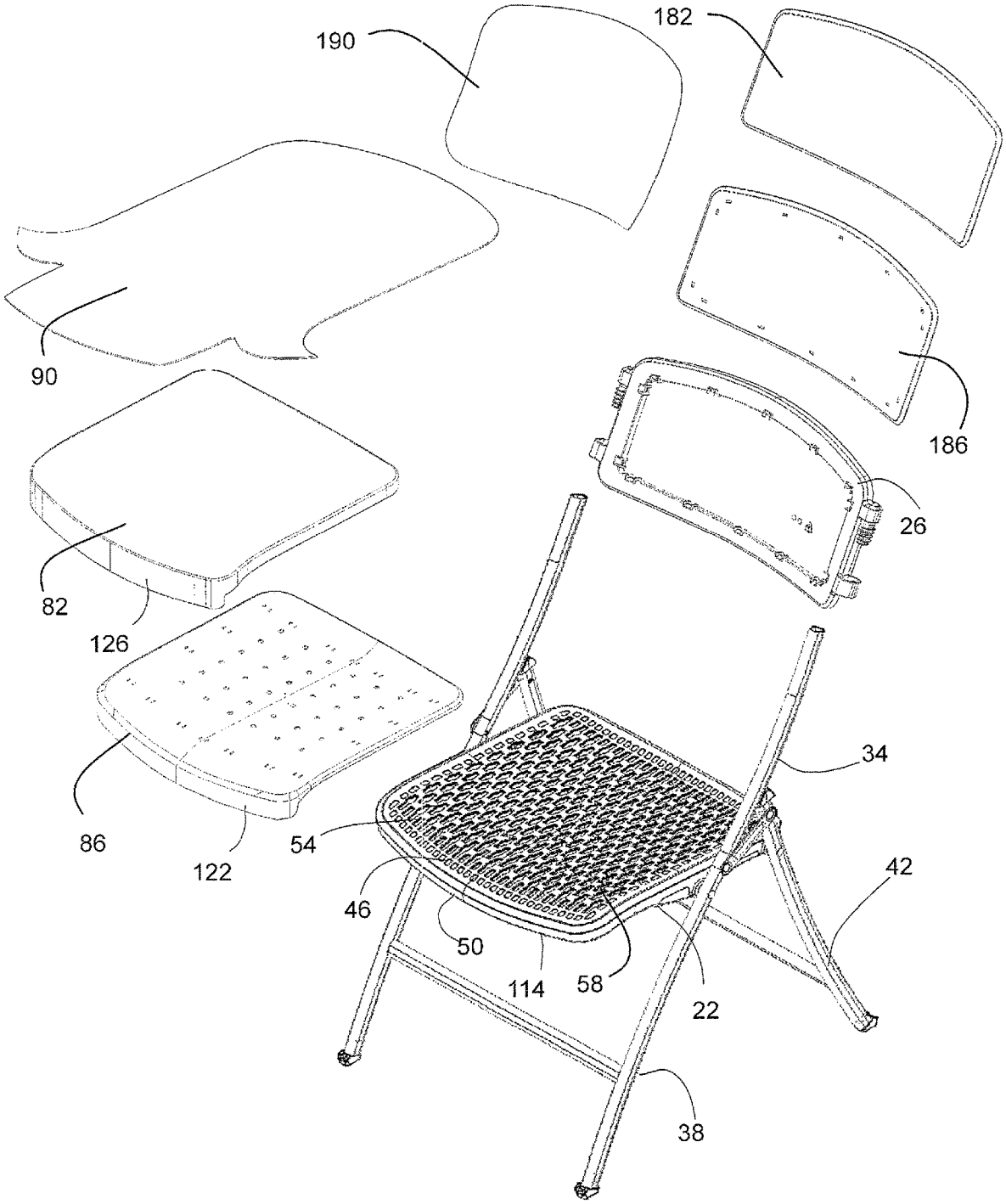
FIG. 1*c* is an exploded perspective view of the folding chair and the cushions of FIG. 1*a;*
Figure 1D:
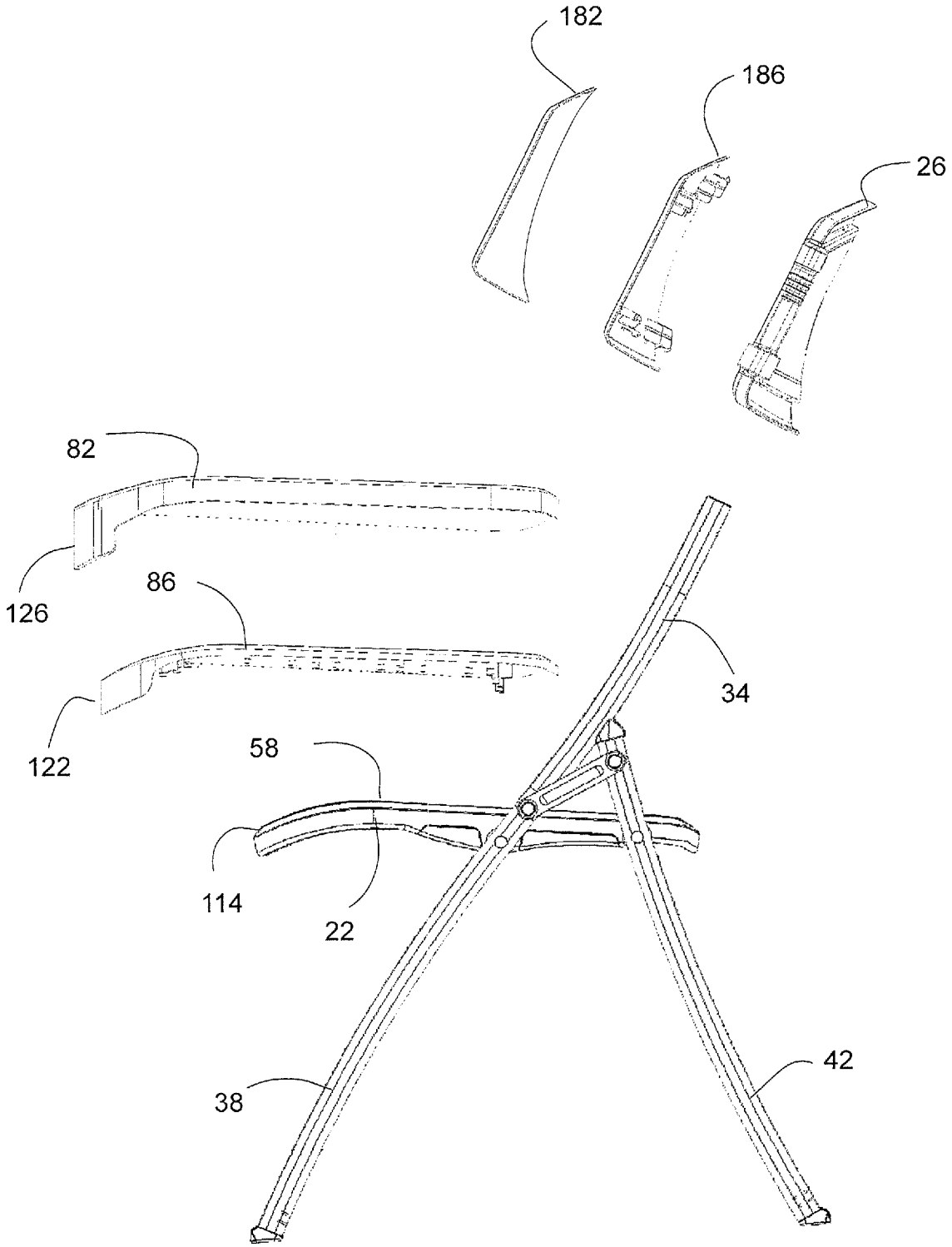
FIG. 1*d* is an exploded side view of the folding chair and the cushions of FIG. 1*a;*
Figure 2A:
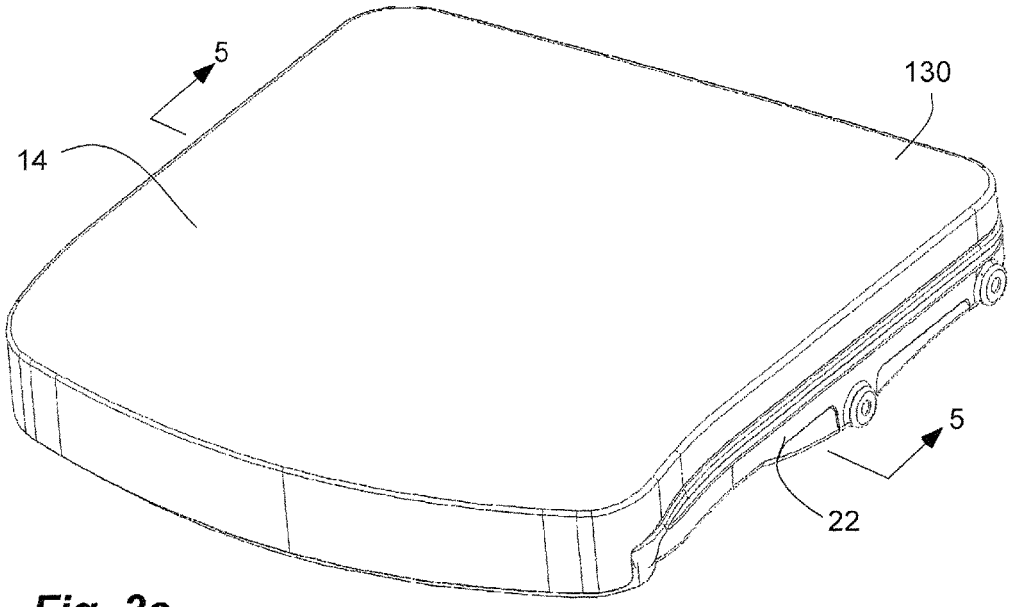
FIG. 2*a* is a perspective view of the seat and the seat cushion of the folding chair of FIG. 1*a;*
Figure 2B:
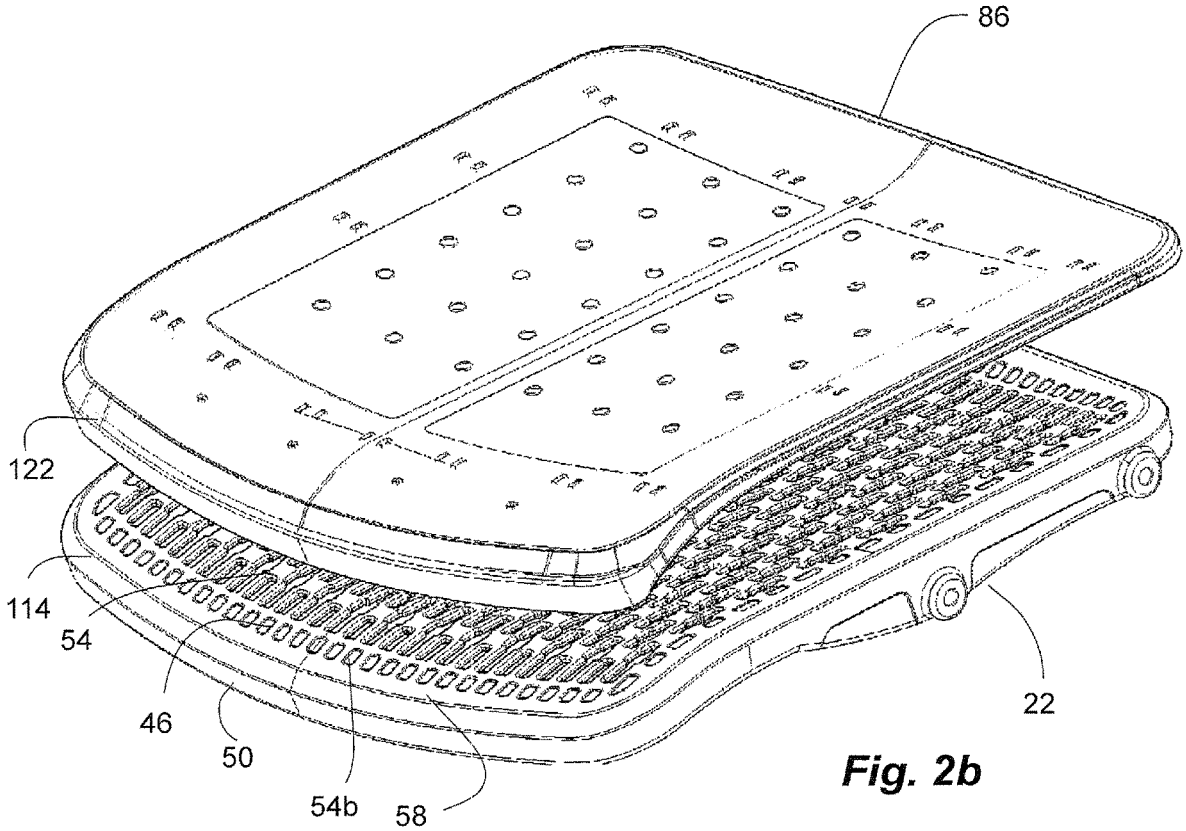
FIG. 2*b* is an exploded view of the seat and a backing of the seat cushion of the folding chair of FIG. 1*a*, shown with the backing of the seat cushion removed from the seat.
Figure 3A:
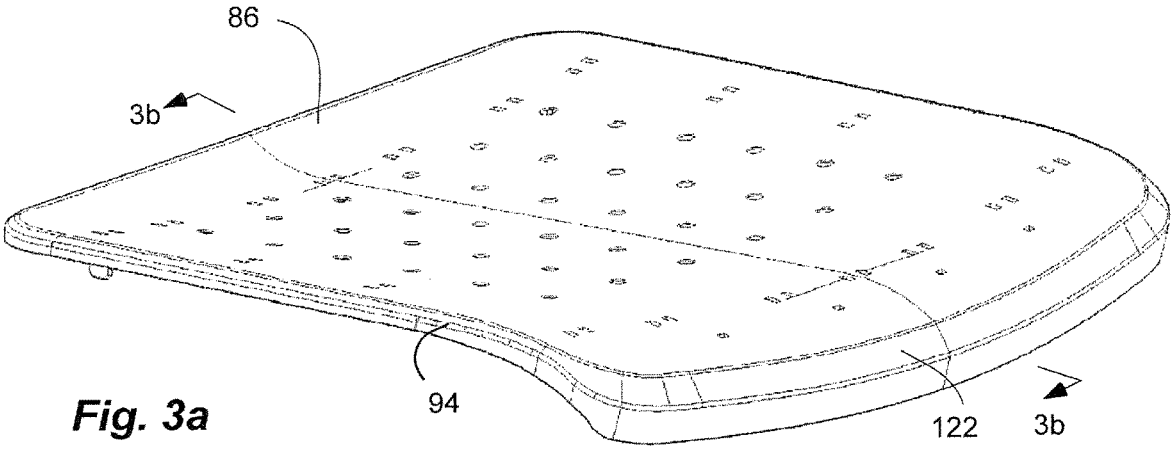
FIG. 3*a* is a top perspective view of the backing of the seat cushion of the folding chair of FIG. 1*a;*
Figure 3B:
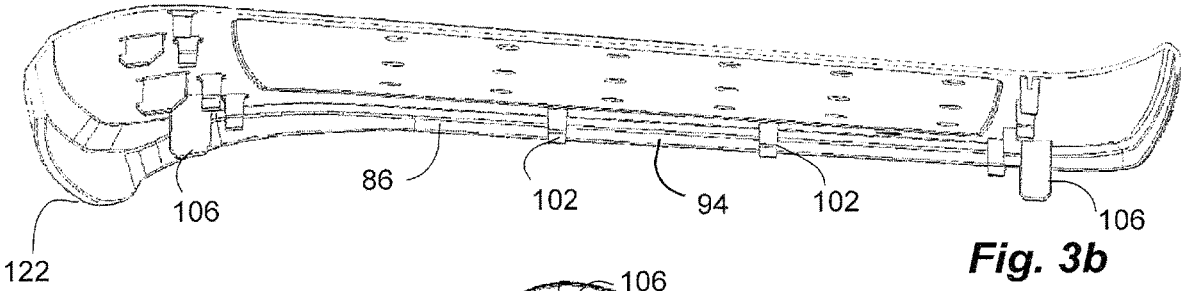
FIG. 3*b* is a cross-sectional side view of the backing of the seat cushion of the folding chair of FIG. 1*a*, taken along line 3*b* of FIG. 3*a;*
Figure 3C:
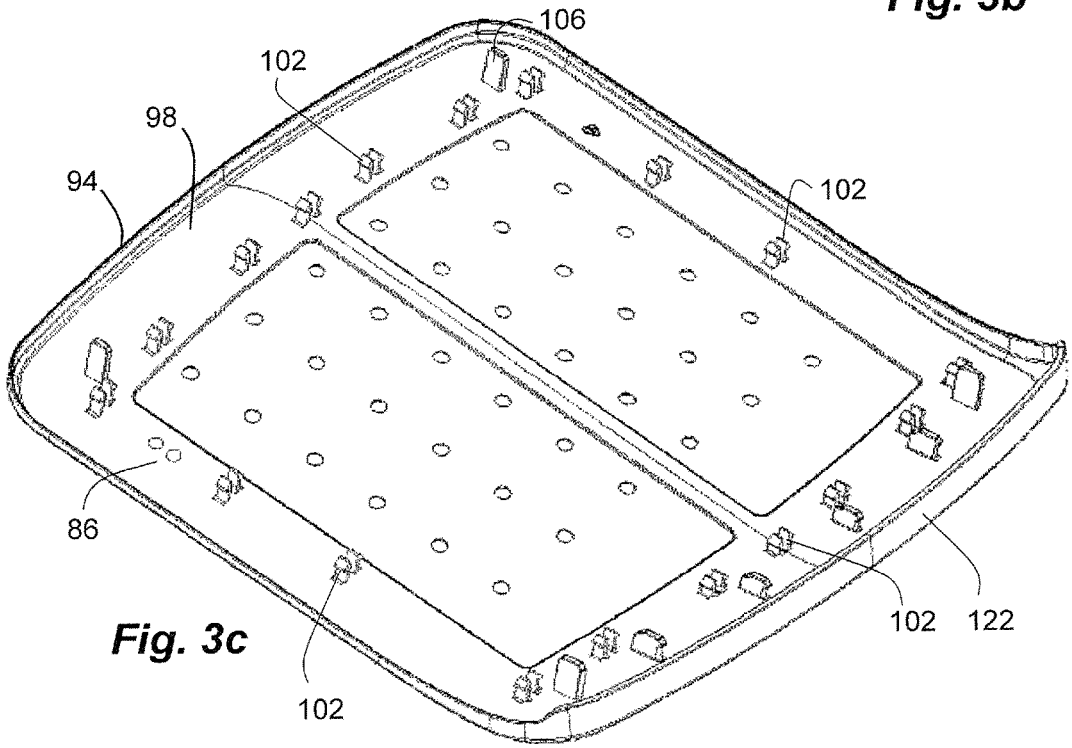
FIG. 3*c* is a bottom perspective view of the backing of the seat cushion of the folding chair of FIG. 1*a;*
Figure 4:
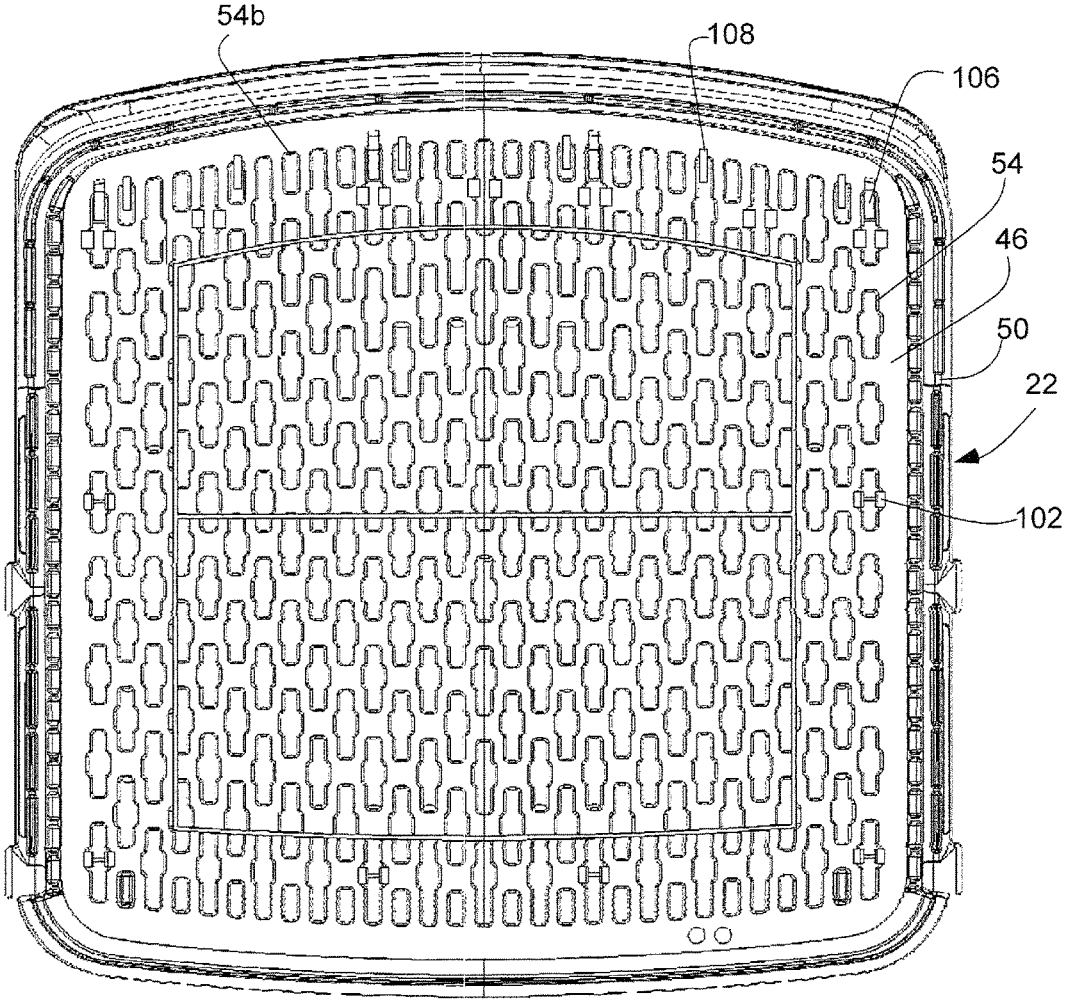
FIG. 4 is a bottom view of the seat with the seat cushion attached thereto of the folding chair of FIG. 1*a;*

The seat 22 can comprise a continuous sheet 46 of flexible and elastic patterned open texture plastic, as shown in FIGS. 1*b*, 1*c* and 2*b*. The sheet 46 is held taut across and substantially covers an opening in a hoop 50 fixed between the frame sides. The sheet 46 comprises an arrangement of openings 54 across the sheet. The openings 54 in the sheet 46 of the seat 22 can be off-set with respect to one another in the lateral or longitudinal direction so that the interstitial material of the sheet 46 between the openings 54 can flex under the applied force of the user's weight. The opening 54, and the interstitial material of the sheet 46, can be formed in a patterned design. The sheet 46 and the hoop 50 can be integrally formed together at the same time, such as by injection molding. The sheet 46 can be distinguished from the hoop 50 by a change in thickness, with the sheet 46 being thinner to provide flexibility, and the hoop 50 being thicker to provide structural support and an attachment to the frame sides. The sheet 46 has an upper surface 58 that defines a first seat surface upon which a user can directly sit. The seat 22 and the sheet 46 can extend continuously between the opposite sides of the frame 30 to form the seat surface. In addition the sheet 46 with the upper surface 58 can be an existing seat and existing seating surface of an existing chair upon which the seat cushion 14 can be added to provide a cushion and an upholstered surface to supplement the comfort and/or aesthetic appearance of the chair 10.

The backrest 26 can comprise an outer surface 62 and a concave recess 66 therein. The recess 66 faces forwardly along with the outer surface 62. The recess 66 has an inner surface 70 in the recess so that the inner surface 70 is recessed with respect to the outer surface 62. A side wall 74 can extend between the outer surface 62 and the inner surface 70. The backrest 26 can have openings 78 therein located behind the outer surface 62. Thus, the openings 78 are recessed with respect to the outer surface 62. In one aspect, the openings 78 can be formed in the side wall 74 adjacent the inner surface 70. Thus, the openings 78 are not exposed on the back of the backrest, and are at least somewhat hidden. The backrest 26 can be flexible and displaceable under an applied force of the user's weight. The backrest 26 can be formed of plastic, and can be formed by injection molding.

Various aspects of the chair, seat and backrest can be found in U.S. Pat. Nos. 8,029,059; 8,033,598; 8,033,612; 8,038,221; and 9,492,014; which are hereby incorporated herein by reference. As described above, the chair 10 can be an existing chair that is supplemented by the seat and/or backrest cushions 14 and 18 to enhance comfort and/or aesthetic appearance. The seat and/or backrest cushions 14 and 18 can take advantage of the structure of the seat 22 or backrest 26, respectively, to attach to the chair 10. In addition, the structure of the seat 22 or backrest 26 can be altered to facilitate attachment. Furthermore, the seat 22 and the seat cushion 14 can work together to provide a comfortable and aesthetic seat, with both deflecting together to provide a synergistic cushioning effect. For example, a cushion of the seat cushion 14 can be engaged first, with a backing of the seat cushion 14 being subsequently engaged to provide additional resilient seat support, and finally the seat 22 and plastic sheet 46 thereof being subsequently engaged to provide further resilient seat support. Similarly, the backrest 26 and the backrest cushion 18 can work together to provide a comfortable and aesthetic backrest, similar to that described above with respect to the seat and seat cushion.

In another aspect, the chair frame can be fixed, with the legs fixed with respect to one another, and the seat and the backrest fixed with respect to one another. Various aspect of the chair can be found in U.S. Pat. Nos. 8,317,269; 8,322,787; and 8,454,093; which are hereby incorporated herein by reference.

The seat cushion 14 can comprise a cushion layer 82 carried by a backing 86 and covered by a layer of upholstery 90. The cushion layer 82 can be a compressible open cell foam that can compress under the applied force of the user's weight. The cushion layer 82 an also be a shape memory foam. The backing 86 can be plastic, and can be flexible to deflect under the applied force of the user's weight. In one aspect, the backing 86 can be thin to allow for flexure or deflection, and otherwise incapable of providing sufficient structure support to the user's weight by itself. The cushion layer 82 and the backing 86 can be thinner and can take advantage of the support and flexibility of the existing seat 22. The backing 86 and the cushion layer 82 can be shaped to match the seat 22. The layer of upholstery 90 extends over the cushion layer 82 and the backing 86. The layer of upholstery 90 wraps around a perimeter of the backing 86. A perimeter of the layer of upholstery 90 can be secured to a back of the backing 86 with fasteners or adhesive, such as staples. Thus, the perimeter of the layer of upholstery 90 extends between the seat cushion 14 and the seat 22.

In one aspect, the seat cushion 14 can have a seam 92 in the front corners of the seat cushion. The seam 92 can be formed by a cut-out in front corners of the layer of upholstery 90. Each cut-out can include a substantially straight edge oriented longitudinally with the seat 22, and an arcuate edge extending substantially laterally with respect to the seat 22. When the edges are hemmed at the seam 92, a frond edge of the layer of upholstery is drawn rearward, forming a front pocket to surround a front edge of the cushion layer 82 and a front edge of the backing 86. Such a configuration can resist fabric bunching along the front edge, front corners, and/or lateral edges of the seat cushion 14.

Figure 5:
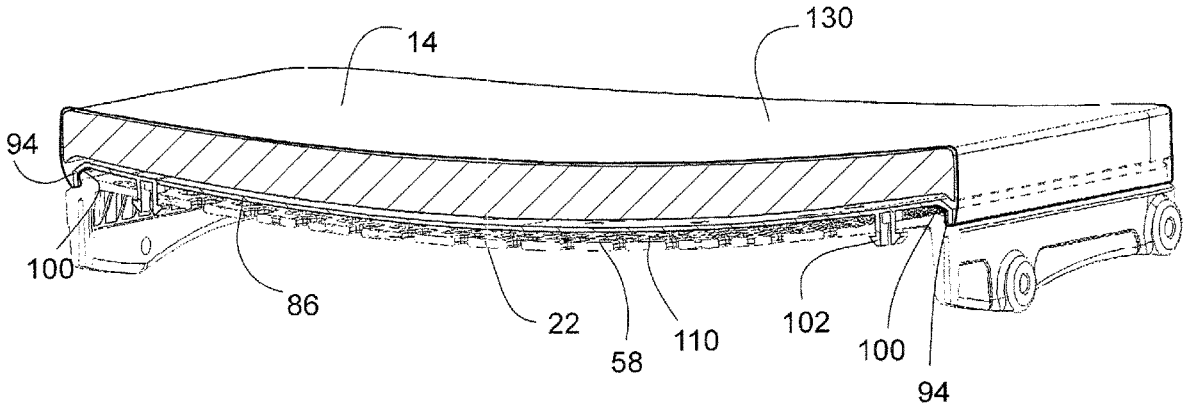
FIG. 5 is a cross-sectional perspective view of the seat and the seat cushion of the folding chair of FIG. 1*a*, taken along line 5 of FIG. 2*a;*

In one aspect, a perimeter of the backing 86 has an angled lip 94 that is angled towards the seat 22 when the seat cushion 14 is disposed on the seat 22. The angled lip 94 forms a concave indentation 98 facing the seat 22 when the seat cushion 14 is disposed on the seat 22. At least a portion of a perimeter of the layer of upholstery 90 can be gathered together in a bunch 100 (FIG. 5) behind the angled lip 94 and in the concave indentation 98, as shown in FIG. 5. Thus, the angled lip 94 resists the bunch 98 of the layer of upholstery 90 from causing a gap between the seat 22 and the seat cushion 14.

In another aspect, the chair 10 has a snap connection attaching the seat cushion 14 to the seat 22. Namely, the snap connection attaches the backing 86 of the seat cushion 14 to the seat 22. The snap connection comprises resilient hooks extending between the backing 86 and the seat 22 and into holes. The hooks can have a head with an angled leading edge and a contiguous orthogonal or perpendicular trailing edge. The leading edge can be angled with respect to an axis of the hole and the hook, while the trailing edge is oriented orthogonal or perpendicular to the axis of the hole and the hook. In addition, the hooks can have a neck that is flexible and resilient. Thus, the hook or neck can deflect when the angled leading edge of the hook abuts a perimeter of the hole, and return once the head clears the hole, with the trailing edge abutting to the perimeter of the hole or the seat on an opposite side from the neck. In one aspect, the hooks 102 (FIGS. 3*b* and 3*c*) can extend from the backing 86 and into the existing openings 54 of the seat 22, or in the sheet 46 of the seat. The backing 86 can have an array or matrix of hooks 102 disposed around the backing, such as near a perimeter of the backing 86 and/or the seat cushion 14. For example, the hooks 102 can be arrayed along the front and back of the backing 86, and along the lateral sides of the backing 86, so that a center of the backing 86 is free to deflect along with the seat 22. In addition, the hooks 102 can be provided in pairs facing opposite directions. Furthermore, the backing 86 can have guide posts 106 extending from the backing 86 and into guide holes, or the openings 54, of the seat 22. The guide posts 106 can be higher or longer than the hooks 102 so that the guide posts 106 can engage the openings 54 before the hooks 102 to align the hooks 102 with the openings 54. Thus, the snap connection utilizes the existing structure of the seat 22, and namely the sheet 46 and openings 54 thereof, so that the sheet 46 and the openings 54 provide a dual function of both a resilient seat support and an attachment.

In another aspect, the opening 54 can include an array of holes 54*b* (FIGS. 2*b* and 4) in the seat 22 adjacent a front edge of the seat. The array of holes 54*b* can be arrayed in a broad arc. An array of hooks 108 can extend from the backing 86 of the upholstered seat cushion 14 adjacent a front edge of the backing 86. The array of hooks 108 can be arrayed in a broad arc. In addition, the array of hooks 108 can be relatively rigid compared to the hooks 102 described above. The array of hooks 108 of the backing 86 of the upholstered seat cushion 14 engage the array of holes 54*b* of the seat 22 or the sheet 54 thereof. The array of hooks 108 can face forward, and hold the front edges of the backing 86 of the seat cushion 14 and the seat 22 together to resist separation by a user lifting on a front edge of the seat 22. In addition, a plurality of the flexible hooks 102 can be arrayed adjacent a front edge of the backing 86 of the seat cushion 14 to engage a plurality of opening 54 adjacent a front edge of the seat 22.

In another aspect, a gap 110 (FIG. 5) can be formed between a bottom of the backing 86 of the seat cushion 14 and the seat surface 58. As described above, the backing 86 can be flexible and resilient, and can displace or deflect under the applied force of the user's weight. Thus, the seat cushion 14 or the backing 86 thereof can initially displace under the applied force, closing the gap 110 and coming into contact with the seat 22, and then the backing 86 of the seat cushion 14 and the sheet 46 of the seat 22 can displace together under the applied force. The backing 86 and the seat 22 can provide a dual displacement member to provide a dual cushion response.

In another aspect, the seat 22 can have a front edge 114 (FIG. 2*b*) curving downwardly and forwardly in a broad arc to provide comfort the user's thighs. Similarly, the seat cushion 14 can have a front curve 118 (FIG. 1) or overlap disposed over and covering the front edge 114 of the seat 22. The front curve 118 of the seat cushion 14 can comprise a front curve 122 (FIGS. 1*c*, 1*d* and 2*b*) on the backing 86, and a front curve 126 (FIGS. 1*c* and 1*d*) on the cushion layer 82.

The seat cushion 14 can thus be disposed on the seat 22 and can cover the seat surface 58 (FIG. 2*b*), or first existing seat surface, and can define a second seat surface 130 (FIG. 1) disposed over the first seat surface 58. Thus, the chair 10 can be provided with the first seat surface 58 formed by the sheet 46 of plastic, and the second seat surface 130 formed by the seat cushion 14. In addition, the second seat surface 130 and the seat cushion 14 can be snapped onto the sheet 46 and the seat 22 with the hooks 102 and openings 54 of the snap connection.

In one aspect, the chair 10 can be provided with the seat cushion 14 preinstalled thereon as a cushioned chair. In another aspect, the seat cushion 14 can be provided as a retrofit for existing chairs to form the cushion chair.

Similar to the seat cushion 14, the upholstered backrest cushion 18 can comprise a cushion layer 182 carried by a backing 186 and covered by a layer of upholstery 190. Many aspect of the above description with respect to the seat cushion are equally applicable to the present description of the backrest cushion, as such description is hereby incorporated herein by reference. The cushion layer 182 can be a compressible open cell foam that can compress under the applied force of the user's weight leaning back against the backrest 26. In another aspect, the cushion layer 182 can be a memory foam. The backing 186 can be plastic, and can be flexible to deflect under the applied force of the user's weight. The layer of upholstery 190 extends over the cushion layer 182 and the backing 186. The layer of upholstery 190 wraps around a perimeter of the backing 186. A perimeter of the layer of upholstery 190 can be secured to a back of the backing 186 with fasteners or adhesive, such as staples.

Figure 6A:
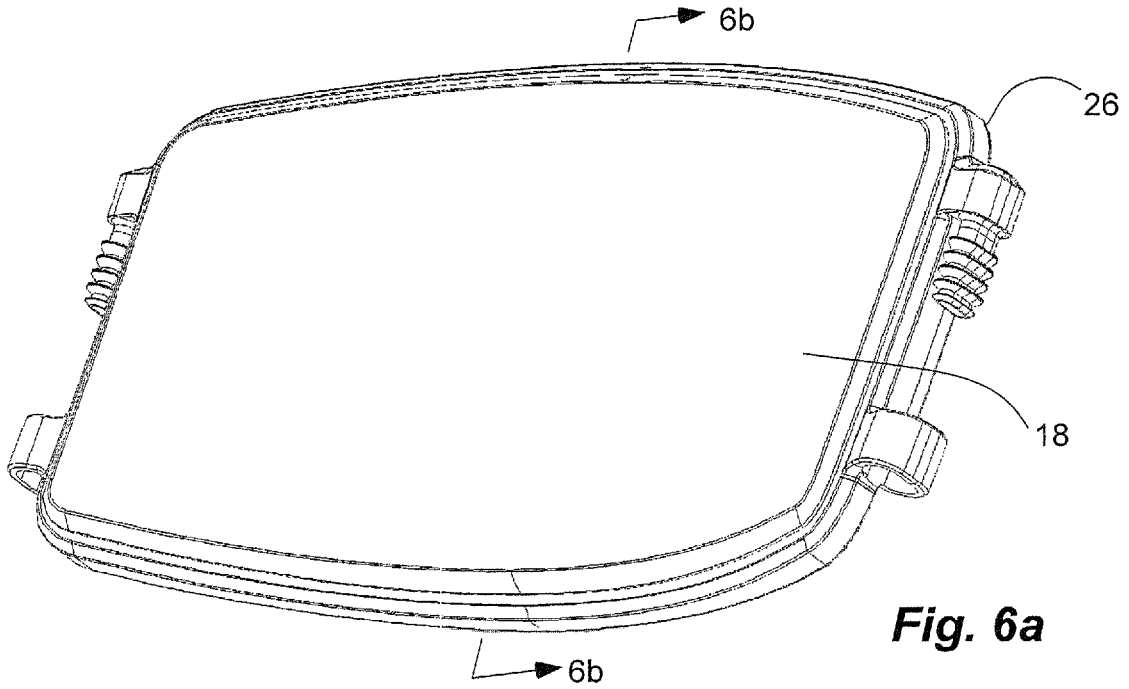
FIG. 6*a* is a perspective view of the backrest and the backrest cushion of the folding chair of FIG. 1*a;*
Figure 6B:
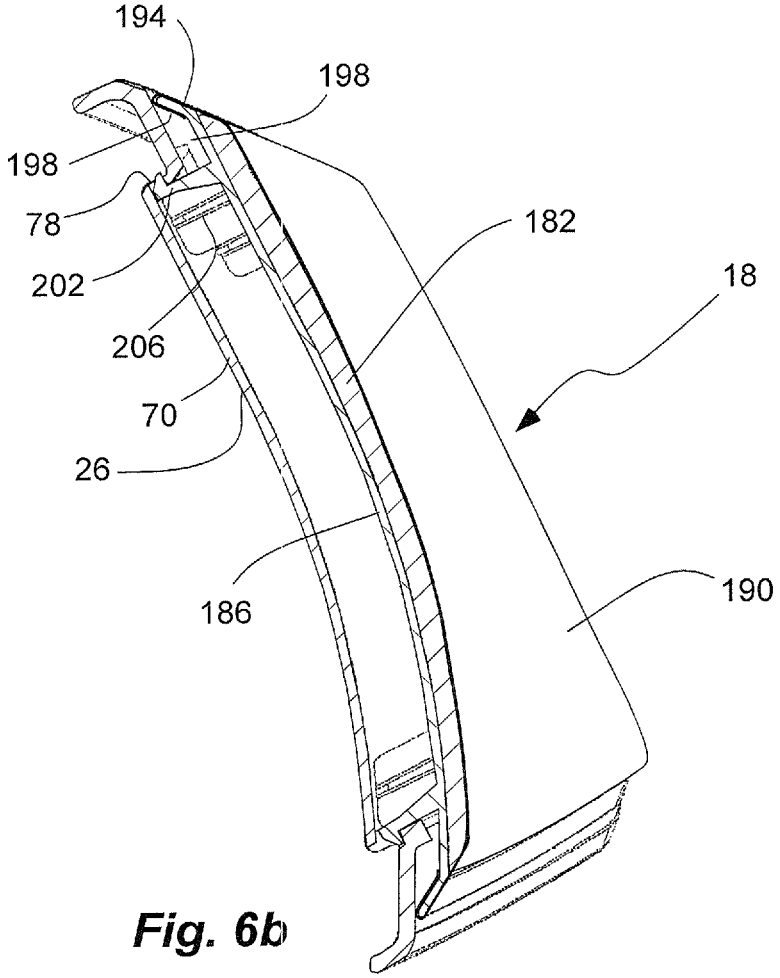
FIG. 6*b* is a cross-sectional perspective view of the backrest and the backrest cushion of the folding chair of FIG. 1*a*, taken along line 6*b* of FIG. 6*a;*
Figure 7:
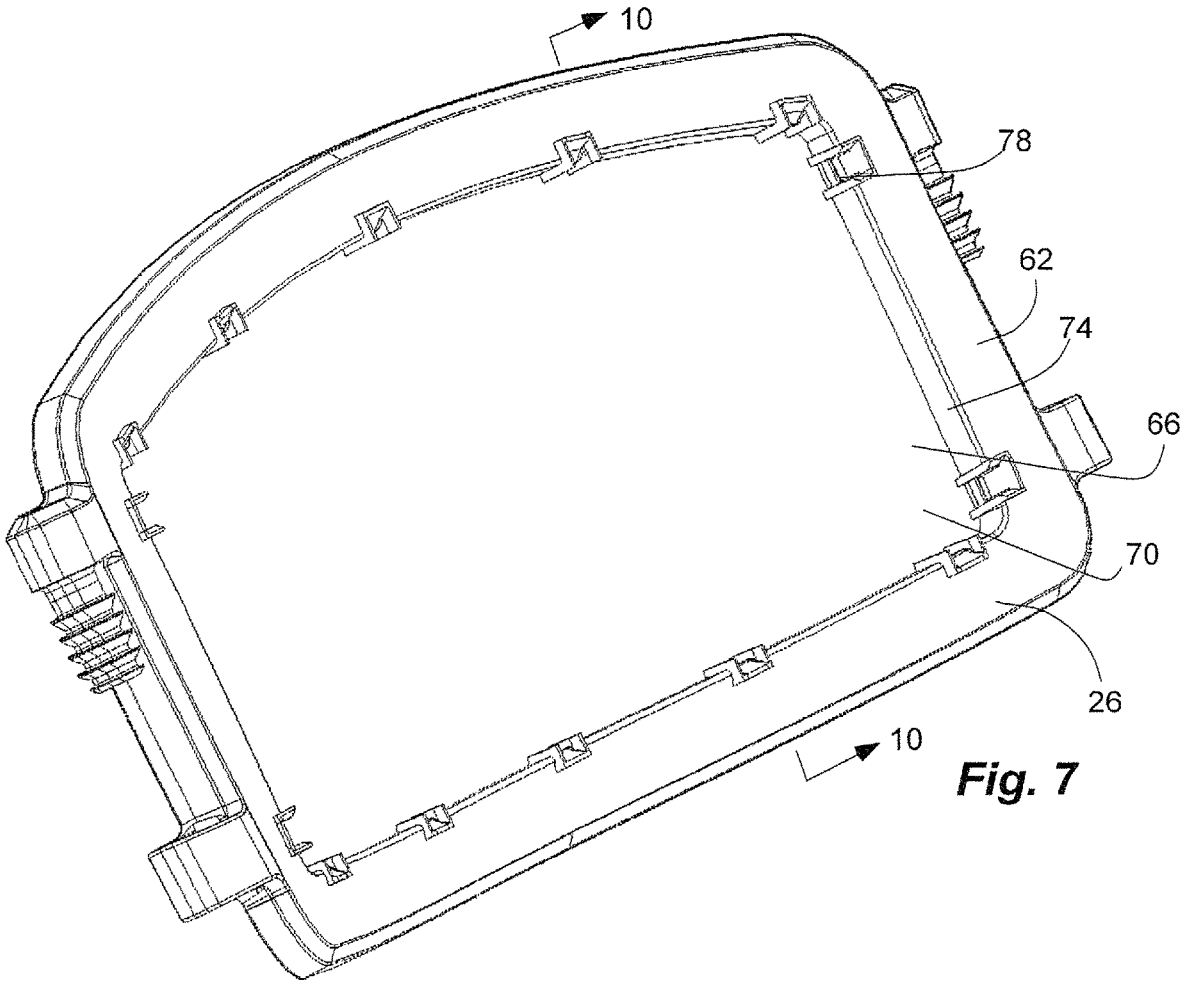
FIG. 7 is a perspective view of the backrest of the folding chair of FIG. 1*a;*
Figure 8:
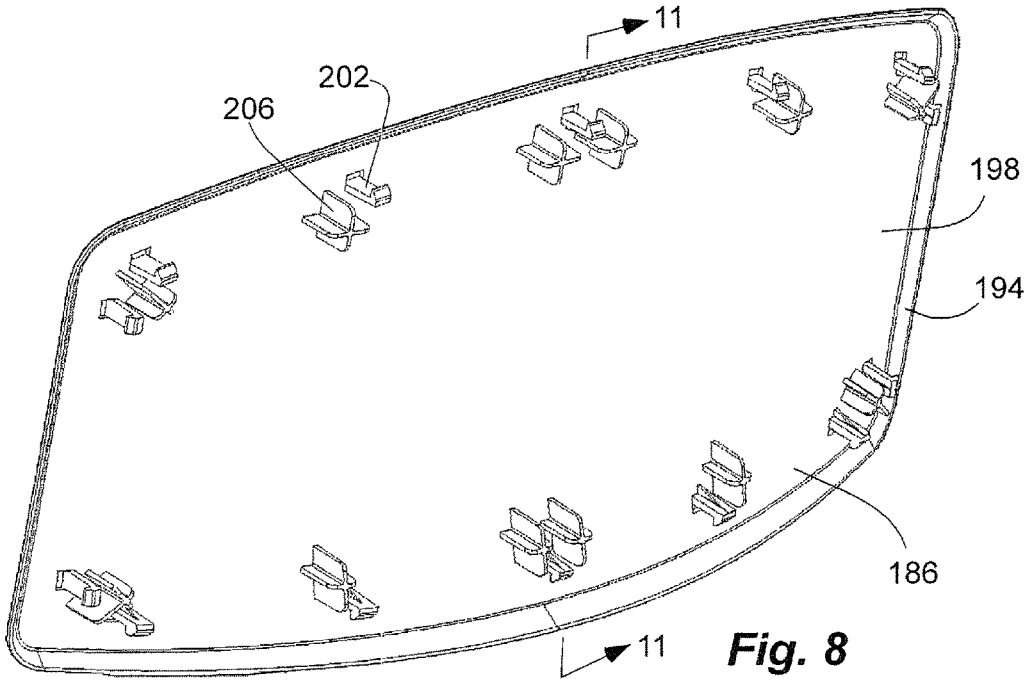
FIG. 8 is a perspective view of a backing of the backrest cushion of the folding chair of FIG. 1*a;*
Figure 9:
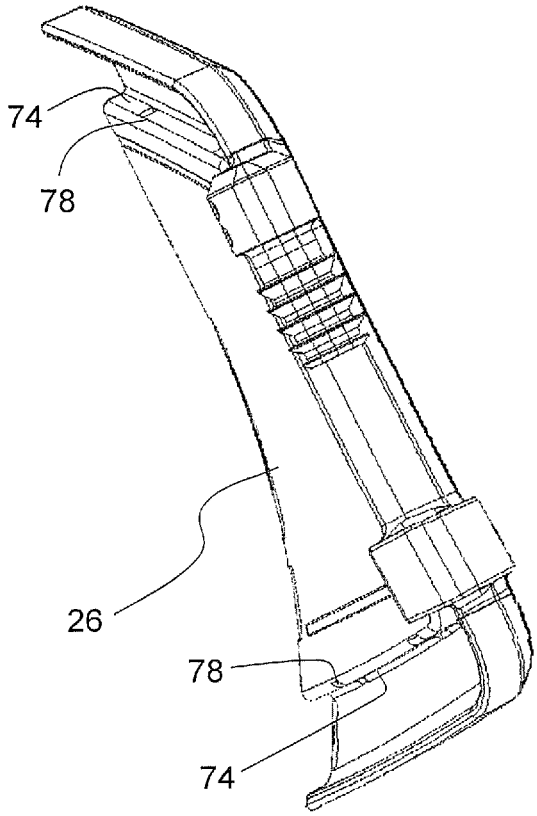
FIG. 9 is a side view of the backrest of the folding chair of FIG. 1*a;*
Figure 10:
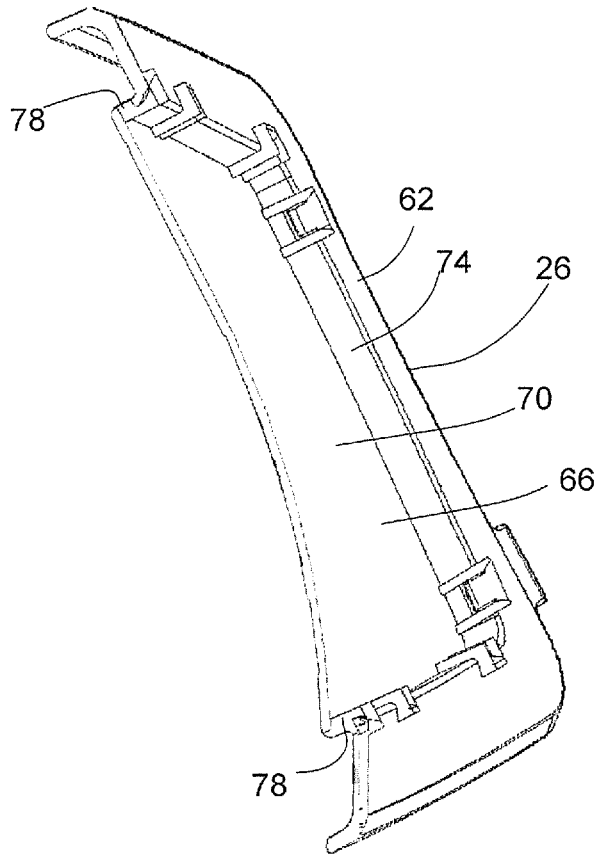
FIG. 10 is a cross-sectional side view of the backrest of the folding chair of FIG. 1*a*, taken along line 10 of FIG. 7.
Figure 11:
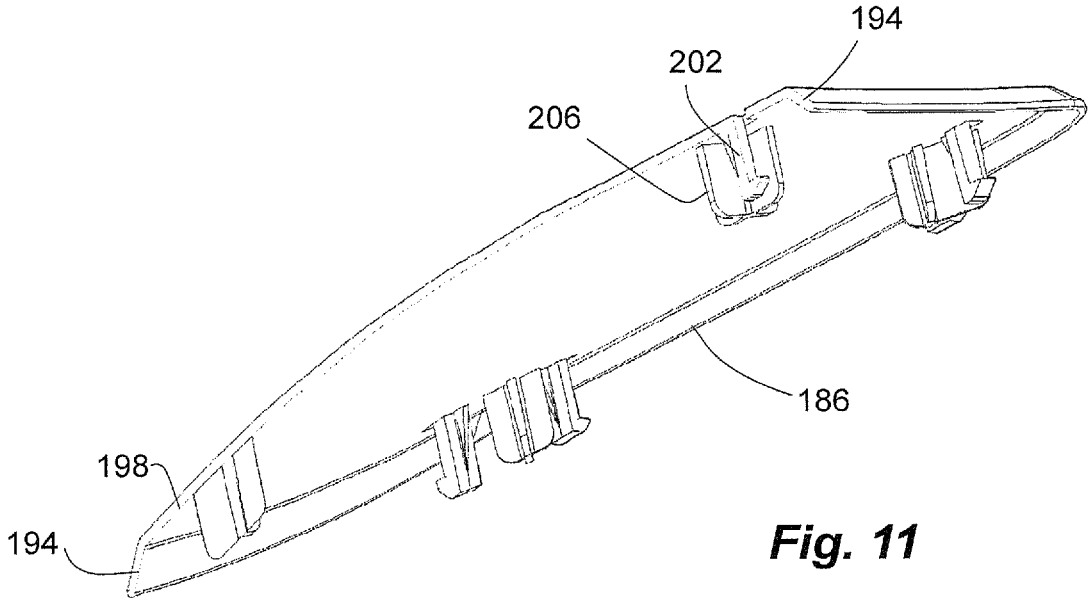
FIG. 11 is a cross sectional perspective view of the backing of the backrest cushion of the folding chair of FIG. 1*a*, taken along line 11 of FIG. 8.

In one aspect, a perimeter of the backing 186 has an angled lip 194 (FIGS. 6*b* and 8) that is angled towards the backrest 26 when the backrest cushion 14 is disposed on the backrest 26. The angled lip 194 forms a concave indentation 198 facing the backrest 26 when the backrest cushion 18 is disposed on the backrest 26. At least a portion of a perimeter of the layer of upholstery 190 can be gathered together in a bunch 198 behind the angled lip 194 and in the concave indentation 198, as shown in FIG. 6*b*. Thus, the angled lip 194 resists the bunch 198 of the layer of upholstery 190 from causing a gap between the backrest 26 and the backrest cushion 18.

In another aspect, the chair 10 has a snap connection attaching the backrest cushion 18 to the backrest 26. Namely, the snap connection attaches the backing 186 of the backrest cushion 18 to the backrest 26. The snap connection comprises resilient hooks extending between the backing 186 and the backrest 26 and into holes. The hooks can have a head with an angled leading edge and a contiguous orthogonal or perpendicular trailing edge. The leading edge can be angles with respect to an axis of the hole and the hook, while the trailing edge is oriented orthogonal or perpendicular to the axis of the hole and the hook. In addition, the hooks can have a neck that is flexible and resilient. Thus, the hook or neck can deflect when the angled leading edge of the hook abuts a perimeter of the hole, and return once the head clears the hole, with the trailing edge abutting to the perimeter of the hole or the seat on an opposite side from the neck. In one aspect, the hooks 202 can extend from the backing 186 and into the openings 78 of the backrest 26. As described above, in one aspect, openings 78 can be formed in the side wall 74 adjacent the inner surface 70. Thus, the openings 78, and the hooks 202 therein, are not exposed on the back of the backrest 26, and are at least somewhat hidden. The backing 186 can have an array or matrix of hooks 202 disposed around the backing, such as near a perimeter of the backing 186 or the backrest cushion 18. In addition, the backing 186 can have stand-offs 206 extending from the backing 186 and abutting to the inner surface 70 of the recess 66 of the backrest 26. The stand-offs 206 can be substantially the same height or length as the hooks 202. The stand-offs 206 can keep the hooks 202 tight in the openings 78 to resist play between the backing 186 or backrest cushion 18 and the backrest 26.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A chair, comprising:

a) a seat and a backrest carried between opposite frame sides each with a backrest support, a front leg and a rear leg;

b) the seat having an upper surface defining a first finished seat surface;

c) an upholstered cushion disposable on and supportable by the seat;

d) the upholstered cushion comprising a cushion layer carried by a backing and covered by a layer of upholstery, the layer of upholstery extending over the cushion layer and wrapped around a perimeter of the backing;

e) the upholstered cushion having a second finished seat surface;

f) the upholstered cushion having at least two configurations, including:

i) separated from the seat and with the first finished seat surface exposed; and ii) attached to and supported by the seat and covering the first finished seat surface with the second finished seat surface exposed; and g) a snap connection attaching the backing of the upholstered cushion to the seat when attached thereto, and comprising resilient hooks extending from the backing of the upholstered cushion and into holes in the seat when attached thereto.

2. The chair in accordance with claim 1, further comprising:

a) the seat being flexible and displaceable under an applied force; and b) the backing of the upholstered cushion being flexible and displaceable together with the seat under the applied force defining a dual displacement member configured to provide a dual cushion response.

3. The chair in accordance with claim 1, further comprising:

a) a perimeter of the backing of the upholstered cushion having an angled lip angled towards the seat, and defining a concave indentation facing the seat; and b) at least a portion of a perimeter of the layer of upholstery gathered together in a bunch behind the angled lip and in the concave indentation.

4. The chair in accordance with claim 1, wherein the snap connection further comprises:

a) guide posts extending from the backing of the upholstered cushion, and into guide holes in the seat, the guide posts being separate and different than the hooks; and b) the guide posts having a height greater than a height of the hooks to engage the guide holes and align the hooks and the holes.

5. The chair in accordance with claim 1, wherein the chair is a folding chair, and further comprising:

a) the seat pivotally coupled to the opposite frame sides and the rear legs pivotally coupled to the front legs and the backrest support; and b) the opposite frame sides having an unfolded seating position in which the seat pivots to extend from the frame sides and bottoms of the front and rear legs move apart, and a folded position in which the seat pivots toward the frame sides and the front and rear legs move together.

6. The chair in accordance with claim 1, further comprising:

a) the seat having a continuous sheet of flexible and elastic patterned open texture plastic held taut across and substantially covering an opening in a hoop fixed between the frame sides, the sheet of patterned open texture plastic comprising an arrangement of openings through and across the sheet;

b) the sheet of patterned open texture plastic having an upper surface defining the first seat surface;

c) the snap connection comprising the hooks extending from the backing of the upholstered cushion and through the openings of the sheet of the seat; and d) the sheet and the openings provide both a resilient seat support and an attachment.

7. The chair in accordance with claim 6, further comprising a gap between a bottom of the backing of the upholstered cushion and the first seat surface; and wherein the backing of the upholstered cushion is flexible and displaceable under an applied force to close the gap and come into contact with the first seat surface of the seat; and wherein the backing of the upholstered cushion and the sheet of the seat are displaceable together under the applied force.

8. The chair in accordance with claim 1, further comprising:

a) the seat having a front edge curving downwardly and forwardly; and b) the upholstered cushion having a front curve disposed over and covering the front edge of the seat.

9. The chair in accordance with claim 1, further comprising:

a) an array of holes through the seat adjacent a front edge of the seat; and b) an array of hooks extending from the backing of the upholstered cushion adjacent a front edge of the backing; and c) the array of hooks of the upholstered cushion extending through the array of holes of the seat.

10. A folding chair, comprising:

a) a seat and a backrest carried between opposite frame sides each with a backrest support, a front leg and a rear leg, and having an unfolded seating position in which the seat pivots to extend from the frame sides and bottoms of the front and rear legs move apart, and a folded position in which the seat pivots toward the frame sides and the front and rear legs move together;

b) the seat having a continuous sheet of flexible and elastic patterned open texture plastic held taut across and substantially covering an opening in a hoop fixed between the frame sides;

c) the sheet of patterned open texture plastic comprising a sheet of plastic material with an arrangement of openings through and across the sheet;

d) the sheet of patterned open texture plastic having an upper surface defining a first finished seat surface;

e) a seat cushion with a second finished seat surface disposable over and supportable by the seat, the seat cushion comprising a cushion layer carried by a backing and covered by a layer of upholstery, with the backing and the cushion layer shaped to match the seat, and the layer of upholstery extending over the cushion layer and wrapped around a perimeter of the backing;

f) the upholstered cushion having at least two configurations, including:

i) separated from the seat and with the first finished seat surface exposed; and ii) attached to and supported by the seat and covering the first finished seat surface with the second finished seat surface exposed; and g) a snap connection attaching the backing of the seat cushion to the seat when attached thereto, and comprising resilient hooks extending from the backing and through the openings in the sheet of the seat when attached thereto.

11. The chair in accordance with claim 10, wherein the backing of the seat cushion is flexible and displaceable under an applied force into contact with the first seat surface of the seat; and wherein the backing of the seat cushion and the sheet of the seat are displaceable together under the applied force.

12. The chair in accordance with claim 10, further comprising:

a) a perimeter of the backing of the upholstered cushion having an angled lip angled towards the seat, and defining a concave indentation facing the seat; and b) at least a portion of a perimeter of the layer of upholstery gathered together in a bunch behind the angled lip and in the concave indentation.

13. The chair in accordance with claim 10, wherein the snap connection further comprises:

a) guide posts extending from the backing of the seat cushion, and into the openings in the sheet of the seat; and b) the guide posts having a height greater than a height of the hooks to engage the openings and alight the hooks and the openings.

14. The chair in accordance with claim 13, further comprising:

a) the seat having a front edge curving downwardly and forwardly; and b) the seat cushion having a front curve disposed over and covering the front edge of the seat.

15. The chair in accordance with claim 13, further comprising:

a) an array of holes through the seat adjacent a front edge of the seat; and b) an array of hooks extending from the backing of the upholstered cushion adjacent a front edge of the backing; and c) the array of hooks of the upholstered cushion engaging the array of holes of the seat.

16. A folding chair, comprising:

a) a seat and a backrest carried between opposite frame sides each with a backrest support, a front leg and a rear leg, and having an unfolded seating position in which the seat pivots to extend from the frame sides and bottoms of the front and rear legs move apart, and a folded position in which the seat pivots toward the frame sides and the front and rear legs move together;

b) the seat having a continuous sheet of flexible and elastic patterned open texture plastic held taut across and substantially covering an opening in a hoop fixed between the frame sides;

c) the sheet of patterned open texture plastic comprising a sheet of plastic material with an arrangement of openings across the sheet;

d) the openings comprising an array of holes in the seat adjacent a front edge of the seat;

e) the sheet of patterned open texture plastic having an upper surface defining a first finished seat surface;

f) a seat cushion with a second finished seat surface disposable over and supportable by the seat, the seat cushion comprising a cushion layer carried by a backing and covered by a layer of upholstery, with the backing and the cushion layer shaped to match the seat, and the layer of upholstery extending over the cushion layer and wrapped around a perimeter of the backing;

g) the upholstered cushion having at least two configurations, including:

i) separated from the seat and with the first finished seat surface exposed; and ii) attached to and supported by the seat and covering the first finished seat surface with the second finished seat surface exposed;

h) a snap connection configured to attach the backing of the seat cushion to the seat, and comprising resilient hooks configured to extend from the backing and into the openings in the sheet of the seat;

i) an array of hooks configured to extend from the backing of the upholstered cushion adjacent a front edge of the backing; and j) the array of hooks of the upholstered cushion configured to engage the array of holes of the seat.

17. The chair in accordance with claim 16, wherein the backing of the seat cushion is flexible and displaceable under an applied force into contact with the first seat surface of the seat; and wherein the backing of the seat cushion and the sheet of the seat are displaceable together under the applied force.

18. The chair in accordance with claim 1, further comprising:

the seat and the backing of the upholstered cushion being flexible and both deflecting together.

19. The chair in accordance with claim 1, further comprising:

a) the seat being deflectable; and b) the backing of the upholstered cushion being free to deflect with the seat.

* * * * *